US005673918A

United States Patent [19]

Bigari

[11] Patent Number: 5,673,918

[45] Date of Patent: Oct. 7, 1997

[54] BALL PLAY SYSTEM WITH BALL CLEANING APPARATUS

[76] Inventor: Steven T. Bigari, 230 N. Field Rd., Colorado Springs, Colo. 80919

[21] Appl. No.: 439,571

[22] Filed: May 11, 1995

[51] Int. Cl.[6] ..... A63B 47/04

[52] U.S. Cl. ..... 273/395; 134/34; 134/195; 134/199; 472/94

[58] Field of Search ..... 273/1.5 R, 398–402, 273/394–397; 482/35; 472/94; 15/21.2; 134/133, 134, 104.2–104.4, 195–200, 34; 473/471, 472, 431–436

[56] References Cited

U.S. PATENT DOCUMENTS

| | | | |
|---|---|---|---|
| 5,353,822 | 10/1994 | Gutterman et al. | 134/133 X |
| 5,361,440 | 11/1994 | Buchbinder et al. . | |
| 5,373,597 | 12/1994 | Worsham . | |
| 5,405,304 | 4/1995 | Petersheim et al. | 482/35 |
| 5,542,440 | 8/1996 | Weimer et al. | 134/133 |

*Primary Examiner*—Paul E. Shapiro
*Attorney, Agent, or Firm*—Timothy J. Martin

[57] ABSTRACT

A ball play system provides a confined play area that has a plurality of balls and a ball cleaning apparatus for cleaning the balls. A target structure is disposed in the play area so that balls which strike a target area pass through a ball supply outlet while balls that miss the target area rebound into the play area. The cleaning apparatus receives balls from a conveyor that communicates with the ball supply outlet of the play area. Cleaned balls from the cleaning apparatus are returned to the play area at a ball inlet by means of a ball return apparatus. The ball return apparatus is a chute, a blower to propel the balls upwardly in the chute to a chute outlet and a rail assembly that receives balls from the chute and returns them to the play area under gravity fee. The rail assembly is serpentine and of a sufficient length so that the cleaned balls undergo drying during transit. A method utilizing this ball play and cleaning system is also disclosed.

16 Claims, 3 Drawing Sheets

BALL PLAY SYSTEM WITH BALL CLEANING APPARATUS

FIELD OF INVENTION

The present invention relates to a ball play system which includes a confined play area containing a plurality of balls so that children can frolic thereabout. More specifically, the present invention is directed to a ball play system incorporating a ball cleaning apparatus so that balls used in the confined play area could be cleaned. A child's play activity within the confined play area supplies the balls to the ball cleaning apparatus.

BACKGROUND OF THE INVENTION

Children love to play. Children can enjoy a wide variety of outdoor play activities during which they entertain themselves and also reap the benefits of physical exercise. Such activities include swimming, bicycle riding and playing on conventional children's play equipment such as swings, slides, teeter-totters and carousals. Children can engage in these playful outdoor activities as long as the weather remains pleasant. However, during inclement weather conditions, children's play usually becomes restricted to indoor activities. Although many indoor activities are available to children for purposes of entertainment, often these indoor activities have limited exercise value.

Recognizing the need to provide children with healthy indoor entertainment, particularly during inclement weather conditions, enterprising businesses now provide indoor playlands for children. Some types of indoor playlands include a serpentine of plastic tubes through which children crawl. Ladders and inclines are used for a child to ascend to higher elevations, and slides are used for the child to descend to lower elevations. Sometimes the serpentine of plastic tubes directs the children into a confined play area. These confined play areas contain thousands of brightly colored balls within which children typically jump and frolic. Also, some children toss the balls about the confined play area. Tossing these balls about the play area poses no danger to the other children because the balls are fabricated from a lightweight plastic and are hollow. Often the confined ball play areas are a stand alone attraction for children without the serpentine tubes and slides.

Maintaining sanitary conditions within a confined ball play area is problematic. Although the children are required to remove their shoes before entering the play area, other concerns arise which require periodic cleaning of the balls. A child's running nose or a child's leaking diaper are two examples illustrating why the balls in the play area require regular cleaning.

One method of cleaning the balls is to hand wash each ball periodically with a cleaning fluid such as a solution of water and chlorine. Hand washing thousands of hollow plastic balls is very time consuming and labor intensive. Another method is to unload the balls from the play area and soak the balls in the cleaning fluid for a specified period of time. However, before the balls can be returned to the play area, each ball must be dried. Drying thousands of balls after cleaning would also be time consuming and labor intensive. For this reason it is possible that some ball play areas may not be as sanitary as they should be.

A need exists to efficiently and effectively clean the balls used in the confined play area. It would be necessary to dry the balls after being cleaned but before returning the balls to the play area. It would be advantageous if the balls could be cleaned and dried while the children are playing in the confined play area. It would also be advantageous if a child's play activity within the play area could contribute to supplying the balls to a ball cleaning apparatus to avoid labor and attendant costs associated with cleaning the balls. The present invention addresses these needs and provides these advantages.

SUMMARY OF INVENTION

It is an object of the present invention to provide a new and useful ball play system incorporating a ball cleaning apparatus operative to clean balls used in a child's play area.

It is a further object of the present invention to provide a ball play system incorporating a ball cleaning apparatus which can clean balls and provide a drying time for the cleaned balls while the children are frolicking about the confined play area.

It is another object of the present invention to provide a ball play system incorporating a ball cleaning apparatus whereby the children frolicking about the confined play area supply the balls to the ball cleaning apparatus.

It is yet another object of the present invention to provide a ball play system incorporating a ball cleaning apparatus which can continuously clean the balls while children are frolicking in the play area as a continuous, closed-loop cycle.

Yet another object of the present invention is to provide a ball play system incorporating a ball cleaning apparatus that is sufficiently compact so that it occupies a minimum of floor space.

According to the present invention, then, a ball play system is described which incorporates a cleaning apparatus as part thereof. Thus, the present invention provides a "close-loop" type system where the balls used in the play system may circulate through the cleaning apparatus and be returned to a play area.

Specifically, the ball play system according to the present invention includes a confined play area that is of sufficient size so that children may play therein. A plurality of balls are disposed in the confined play area, and the confined play area has a ball supply outlet and a ball inlet. A conveyor is in communication with the ball supply outlet of the play area by means of a conveyor so that balls move from the play area, out of the ball supply outlet and into a ball cleaning apparatus by way of the first conveyor. Balls are cleaned by the ball cleaning apparatus as cleaned balls and then returned to the play area at the ball inlet by means of a ball return apparatus in communication with the ball cleaning apparatus.

Preferably, balls to be cleaned are placed in the ball supply outlet by the children who are playing in the confined play area. To encourage such activity, a target structure is disposed in the confined play area, and the ball supply outlet is associated with the target structure. This target structure is constructed such that first balls that are accurately directed toward a target area of the target structure will be received by the ball supply outlet; second balls that are inaccurately directed toward the target area of the target structure will rebound into the confined play area. This target structure can take a variety of configurations but, for example, may be a typical bullseye structure with the ball supply outlet being an opening at the center "bullseye" area of the target. Another example is forming the target structure as a basketball hoop assembly with the target area being the basketball hoop. Balls passing through the basketball hoop then enter the ball supply outlet.

The ball cleaning apparatus of the present invention includes a reservoir which holds the cleaning fluid. An upright portion, such as an upright tubular section, receives balls to be cleaned and is sized such that the balls pass therethrough in single file. At least one, but preferably two spray nozzles are disposed in the upright portion and are oriented to direct a spray of the cleaning fluid onto the balls thereby to produce the cleaned balls. A transverse portion is then in communication with the upright portion, and this transverse portion may be a transverse tube through which the cleaned balls may pass. A pump is then operative to circulate the cleaning fluid from the reservoir to and through the spray nozzles. Preferably, the ball cleaning apparatus includes a storage bin which communicates with the upright portion. The storage bin is operative to receive the balls from the conveyor that communicates with the ball supply outlet. A stirring element is disposed in the storage bin and is operative to circulate the balls in the storage bin. The storage bin has a storage bin outlet that is sized such that the balls exit therefrom and into the upright portion in a single file. In order to return the cleaned balls to the play area, the ball return apparatus includes an upright chute disposed to receive the cleaned balls from the transverse portion of the ball cleaning apparatus. A blower communicates with the upright chute and is operative to direct a stream of air against each of the cleaned balls that enters the chute thereby to propel each cleaned ball upwardly through the chute to a chute outlet. A rail assembly is then provided in communication with the chute at the chute outlet. This rail system preferably is serpentine in configuration and is constructed so that cleaned balls are advanced or rolled therealong under the force of gravity. The serpentine rail assembly terminates at the ball inlet of the confined play area. Preferably the rail system is sufficiently extended in length so that the cleaned balls have the opportunity to air dry as they are advanced therealong.

The ball cleaning apparatus may further include a drain associated with each of the upright portion and the transverse portion so that excess cleaning fluid from the cleaned balls and from the nozzle will drain back into the reservoir so that the cleaning fluid circulates in a closed-loop from the reservoir, through the pump and spray nozzles after which it may drain back into the reservoir. Preferably the drain for the upper tube portion is located at a lower end thereof, and a grate structure is disposed in the upright portion at such a location to direct cleaned balls into the transverse portion while allowing the cleaning fluid to pass through the grate structure and out of the drain so that it returns to the reservoir. The transverse portion of the cleaning apparatus may also have an access opening formed therein whereby damaged ones of the cleaned balls may be removed by the operator.

In addition to the ball play system and the cleaning apparatus described above, the present invention also includes a method for cleaning balls used in a confined play area. This method broadly includes the steps of first depositing the balls contained in the confined play area into a ball supply outlet located in the confined play area. Next, the balls so deposited are mechanically conveyed to a cleaning apparatus located remotely of the confined play area. The balls are then cleaned with a cleaning fluid associated with the ball cleaning apparatus. Finally, the cleaned balls are then returned to the confined play area. This method preferably includes the step of mechanically conveying the balls from the ball supply outlet to a storage bin associated with the cleaning apparatus and the step of mechanically conveying the balls from the storage bin through a spray of cleaning fluid. This method may also include the step of returning the cleaned balls to the confined play area along a serpentine path of sufficient length such that the cleaned balls are at least partially dried during transit. This step is accomplished by means of the step of pneumatically propelling the cleaned balls from the ball cleaning apparatus to a rail assembly that receives the cleaned balls and that is configured so that the balls travel to the confined play area under the force of gravity.

These and other objects of the present invention will become more readily appreciated and understood from a consideration of the following detailed description of the preferred embodiment of the present invention when taken together with the accompanying drawings, in which:

DETAILED DESCRIPTION OF THE PREFERRED EMBODIMENTS

The present invention generally relates to a ball play system incorporating a ball cleaning apparatus. The present invention enjoys the benefit of having a child's play activity contribute to the cleaning of balls contained in a child's play area by having children toss balls at a target structure to deposit balls into a ball supply outlet. Further, the ball cleaning apparatus is designed as being compact in order to occupy a minimum amount of space and provide entertainment value to one observing the operations of the cleaning apparatus. One of ordinary skill in the art would then appreciate that the ball play system can function with other ball cleaning apparatus and that the ball cleaning apparatus could be used to clean balls from any play area without requiring the close-loop ball play system described herein.

Figure 1:
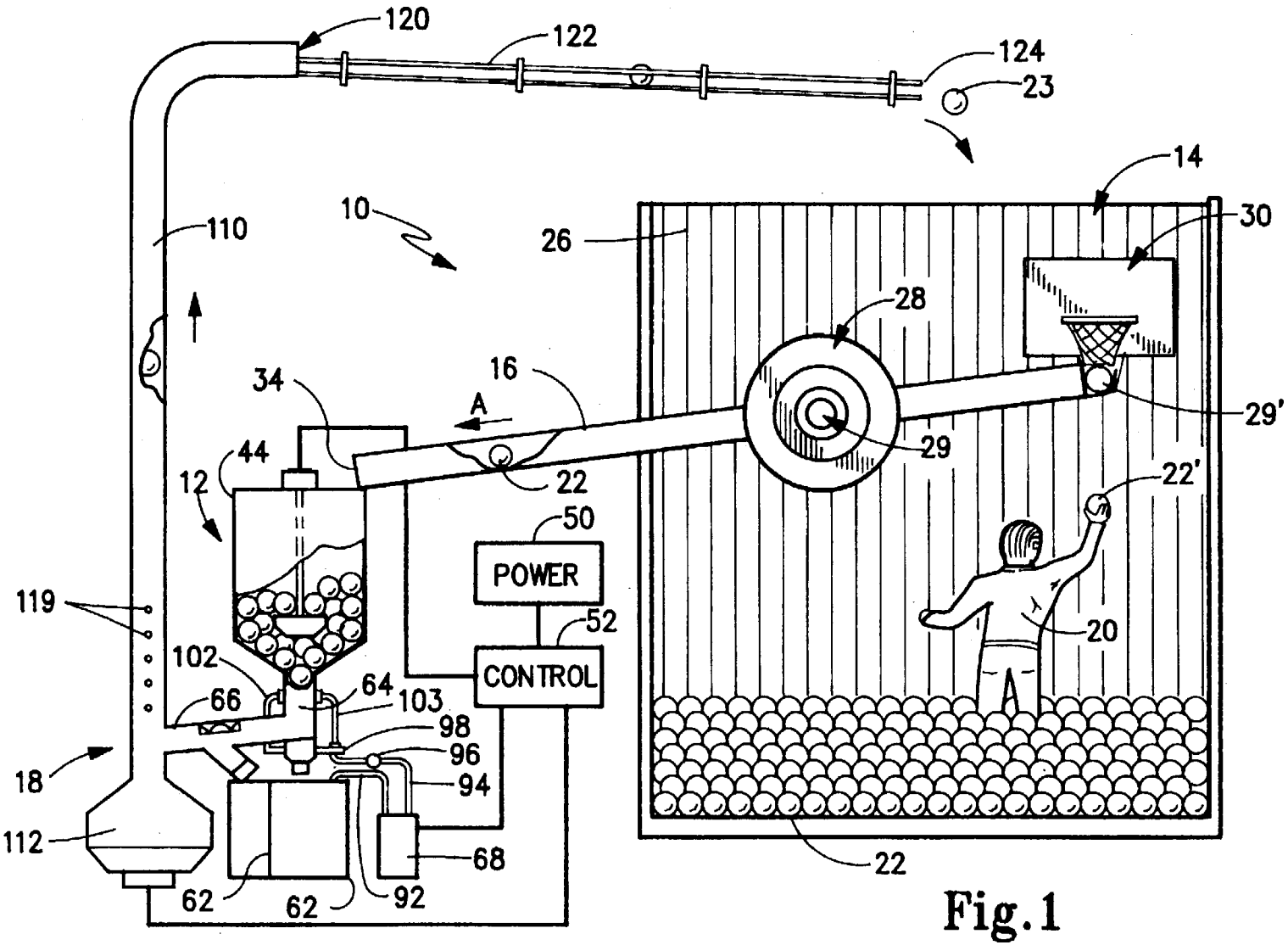
FIG. 1 is a diagrammatic view of a ball play system incorporating a ball cleaning apparatus of the present invention showing a child's confined play area wherein a child tosses one of a plurality of hollow, plastic balls contained therein.

According to the present invention, a ball play system 10 incorporating a ball cleaning apparatus 12 is generally introduced in FIG. 1, and it should be understood that this diagrammatic view is illustrative only and is not in exact proportions. The proportions, of course, are dependent on the size of the balls used as readily apparent to those skilled in this art. Accordingly, then, ball play system 10 includes a confined play area 14, ball cleaning apparatus 12, a ball supply conduit or conveyor 16 and a ball return apparatus 18. The confined play area 14 is sized and adapted so that a child 20 or children may play therein.

Confined play area 14 receives a plurality of balls 22 and may include a net 26 supported in any convenient manner. Confined play area 14 has two target structures 28 and 30 although target structure would be adequate to practice the present invention. Target structures 28 and 30 are mounted within confined play area 14. Target structure 28 is formed as a "bullseye" target while target structure 30 is formed as a basketball hoop, for representative purposes. In any event, target structures 28 and 30 are operative so that accurately tossing one of the plurality of balls 22 contained in confined play area 14 within the respective target area 29, 29' of the target structures 28, 30 deposits the accurately tossed ball 22' into the ball conveyor 16 as depicted in FIG. 1. Inaccurately tossing another one of the plurality of balls 22 contained within confined play area 14 so that it impacts outside of target area of the respective target structure 28, 30 causes the inaccurately tossed ball to rebound back into confined play area 14. Thus, target areas 29, 29' define ball supply outlets for the confined play area. This feature is an advantage of the present invention in that the play activity of child 20 in confined play area 14 contributes to the cleaning of the balls by loading the balls to ball cleaning apparatus 12 as described in further detail hereinbelow. Children 20 are enticed to toss the balls 22 at target structures 28 and 30 due to the various designs of target structures. One of ordinary skill in the art would appreciate that a variety of designs could be used as target structures 28 and 30 to entice children 20 to toss additional balls 22 to supply balls to ball cleaning apparatus 12.

Figure 3:
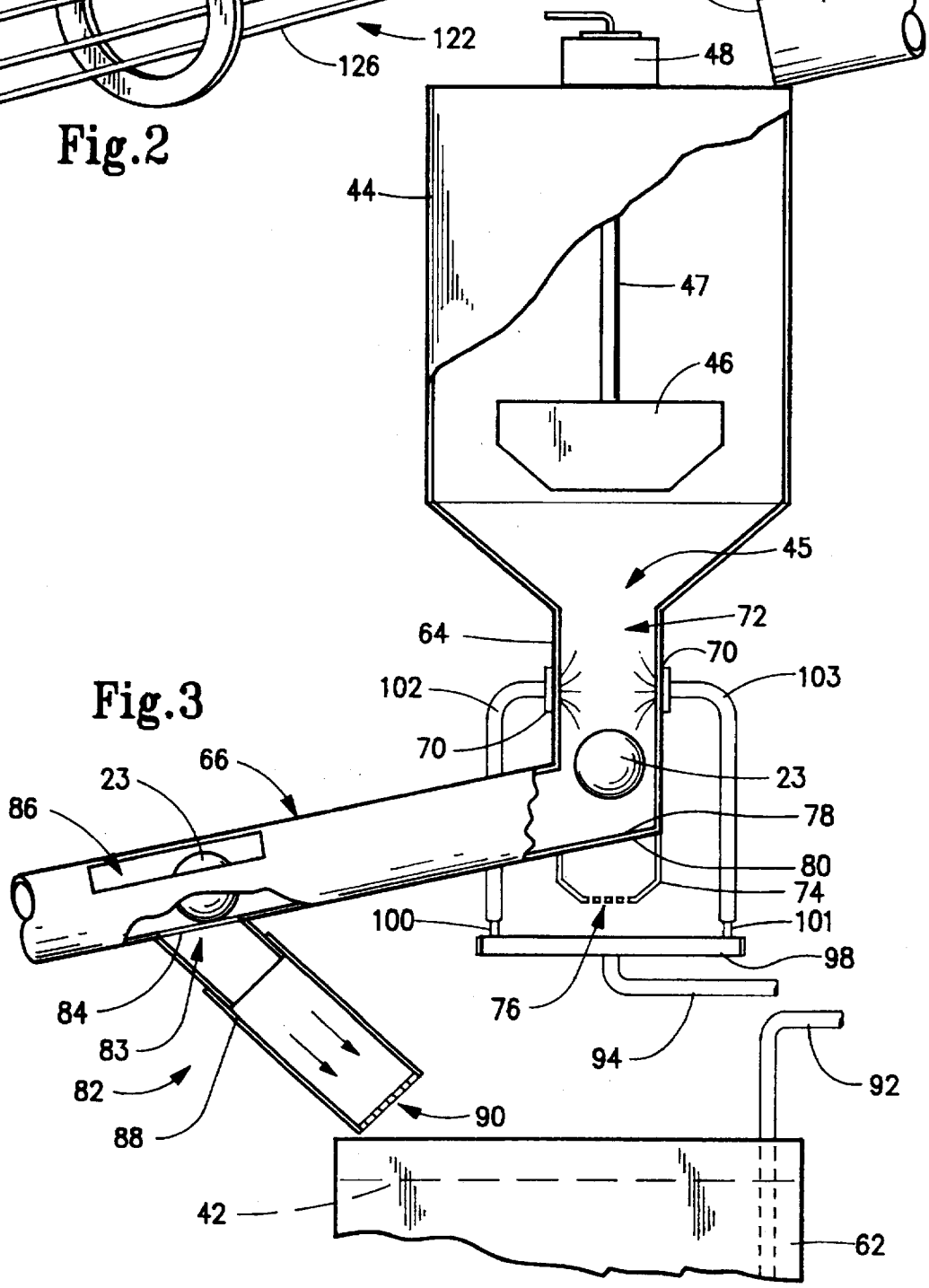
FIG. 3 is an enlarged view partially broken away of the ball cleaning apparatus shown in FIG. 1.

With reference to FIGS. 1 and 3, it may be seen that ball conveyor 16 is an elongated tube that communicates with ball supply outlets 29, 29' and is operative to convey balls 22 from ball supply outlets 29, 29' to ball cleaning apparatus 12. A storage bin 44 is associated with ball cleaning apparatus 12 and is operative to receive balls from conveyor 16. As shown in FIG. 1, this storage bin 44 supports a downstream end 34 of conveyor 16 so that balls deposited in ball supply outlets 29, 29' will advance under gravity through conveyor 16 in the direction of arrow "A" and fall into storage bin 44. One of ordinary skill in the art would appreciate that ball conveyor 16 can be directly connected to ball cleaning apparatus 18 without departing from the spirit of the present invention. Storage bin 44 has a storage bin outlet 45 that is sized to cause balls 22 received in storage bin 44 to exit therefrom in single file. A stirrer in the form of a paddle 46 that is mounted on shaft 47 is rotated by a motor 48 in order to circulate balls 22 in storage bin 44. This helps prevent cavitation of the balls 22 in storage bin 44 to ensure that they will exit single file out of storage bin outlet 45.

Ball cleaning apparatus 12 of the present invention, is again best shown in FIGS. 1 and 3. Ball cleaning apparatus 12 broadly includes an upright portion 64, a transverse portion 66, a fluid reservoir 62 and a pump 68 with its associated filtering element and conduit system. Ball cleaning apparatus 12 is thus adapted for use to clean the plurality of balls 22 with any cleaning fluid that is known in the art. Preferably, the cleaning fluid is a solution consisting 100 parts of chlorine per million parts of water, and cleaning fluid 42 is held in reservoir 62 as shown in FIG. 3.

Upright portion 64 of ball cleaning apparatus 12 is generally in the form of a vertical tube that receives balls 22 from storage bin outlet 45 and allows balls 22 to advance downwardly under the force of gravity past a pair of nozzles 70 that are diametrically opposed to one another at a medial location of upright portion 64. Nozzles 70 are oriented to spray cleaning fluid 42 generally radially into the interior 72 of upright portion 64 against any balls 22 passing therethrough. Thus balls 22 become "cleaned" balls such as cleaned ball 23 shown in FIG. 3. A lower end 74 of upright portion 64 is oriented above reservoir 62 and provides a drain 76 so that excess cleaning fluid from nozzles 70 may drain back into reservoir 62. A grate structure 78, in the form of a pair of transverse rods 80 extend across upright portion 64 at the juncture of upright portion 64 and transverse portion 66. Grate structure 78 allows the cleaning fluid to pass therethrough to drain 76 while at the same time directing the cleaned balls 23 into transverse portion 66.

Transverse portion 66 is also in the form of an elongated tube that conveys cleaned balls 23 from upright portion 64 to ball return apparatus 18, as described below, again under gravitational force. Transverse portion 66 has an access opening 86 that allows damaged balls to be removed therefrom by an operator. A drain 82 is also provided for transverse portion 66. Here, an opening 83 is formed in a lower wall of transverse portion 66 and guide rails 84 extend across opening 83 to support balls 23 as they pass thereacross. A Y-shaped tube 88 communicates with opening 83 to allow excess fluid from cleaned balls 23 to drain through drain 90 into reservoir 62.

As is shown in FIGS. 1 and 3, pump 68 receives fluid from reservoir 62 by way of conduit 92 and supplies fluid through supply conduit 94 and valve 96 to a manifold 98. Manifold 98 has a pair of outlets 100, 101 which respectively supply cleaning fluid 42 to nozzle 70 through conduits 102 and 103, respectively.

Figure 4:
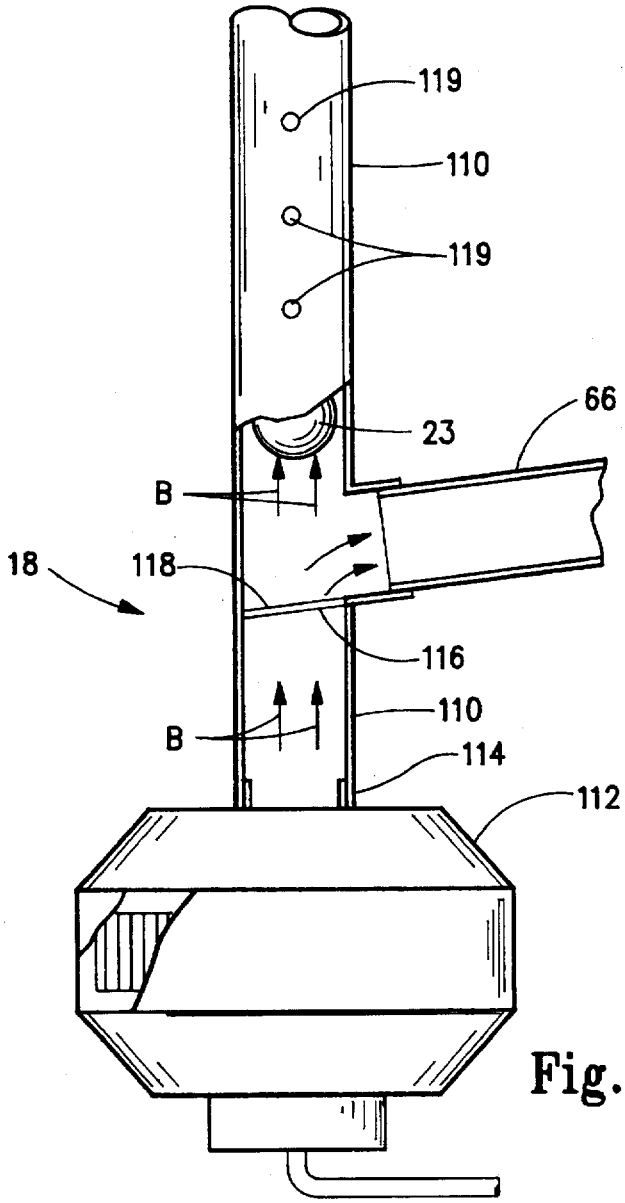
FIG. 4 is a perspective view partially broken away of a dryer housing for a dryer assembly of the ball cleaning apparatus shown in FIG. 1.

With reference to FIGS. 1 and 4, it may be seen that ball return apparatus 18 includes a chute 110 that receives cleaned balls 23 from transverse portion 66 of cleaning apparatus 12. Chute 110 is oriented in an upright manner and has a motor operated blower 112 located at a lower end 114 thereof. Blower 112 is operative to direct a stream of air upwardly against each individual cleaned ball 23 that is received in chute 110 from transverse portion 66, as is shown by arrows "B" in FIG. 4. To this end, a grate structure 116 is provided at the junction of transverse portion 66 of cleaning apparatus 12 and chute 110. As is shown in FIG. 1, grate structure 16 is in the form of at least one transverse rod 118 which extends generally diametrically across chute 110.

With reference to FIG. 1, it should be appreciated that blower 112 is of sufficient strength to propel cleaned balls 23 upwardly through chute 110 and out of chute outlet 120 onto a rail assembly 122. Chute 110 includes a plurality of ports 119 to allow a small amount of blown air from blower 112 to exit chute 110 to decrease the energy imparted to cleaned balls 23 that are propelled pneumatically through chute 110.

Figure 2:
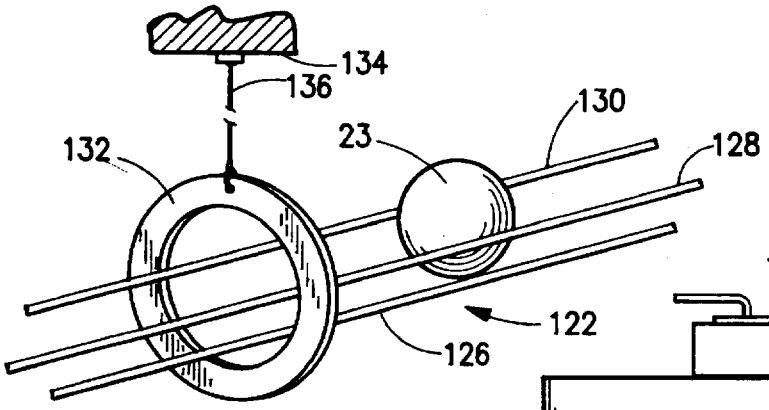
FIG. 2 is a partial perspective view of a rail system which is used to return the balls cleaned by the ball cleaning apparatus of the present invention to the child's confined play area.

Rail assembly 122 is preferably serpentine in shape and is of sufficient pitch so that balls exiting chute outlet 120 will roll therealong to the downstream end 124 of rail assembly 122. Thus, downstream end 124 of rail assembly 122 defines the ball inlet for confined play area 14. As is best shown in FIG. 2, rail assembly 122 is formed by a lower rail 126 and a pair of side rails 128, 130 which support a cleaned ball 23 therein. Rails 126, 128 and 130 are mounted by a plurality of support rings, such as support ring 132, that are each suspended from ceiling 134 by means of a guy wire 136. Thus, rail assembly 122 may be configured in any desired path, such as one or more times around the perimeter of a room which houses the ball play system of the present invention. As noted, it is preferred that rail assembly 122 be configured in a serpentine path, and it is desired that the serpentine path have sufficient length so that cleaned balls 23 will at least partially dry of cleaning fluid as they are advanced under the force of gravity along rail assembly 122. This is further advantageous since, in the typical ball play system, the balls are pigmented with bright colors. Thus, as the cleaned balls 23 roll along rail assembly 122, a pleasing visual display is presented.

Figure 5:
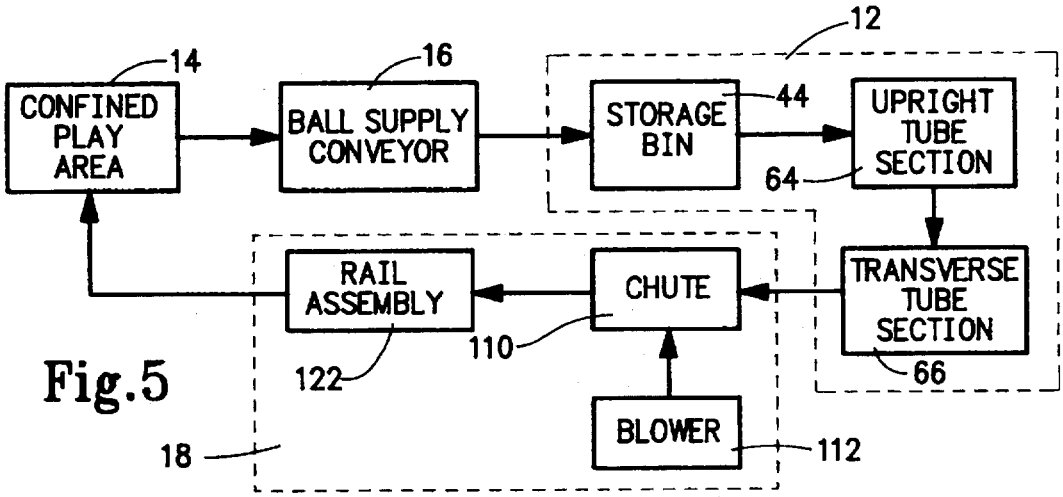
FIG. 5 is a block diagram illustrating a method for practicing the ball play system incorporating the ball cleaning apparatus of the present invention.

With reference to FIG. 5, a block diagram reflects how balls 22 cycle in a continuous loop through ball play system 10 incorporating ball cleaning apparatus 12. Child 20 frolicking in confined play area 14 supplies balls 22 to conveyor 16 through ball supply outlet 29 or 29' by tossing ball 22 within target areas of target structures 28, 30 respectively. Thus, child 20 provides the necessary labor to supply balls 22 to ball cleaning apparatus 12 at no cost. First ball conveyor 16 mechanically conveys balls 22 from ball supply outlets 29, 29' to storage bin 44. Balls 22 in storage bin 44 are supplied single file to the upright and transverse tube sections of ball cleaning apparatus 12. Balls 22 are conveyed through ball cleaning apparatus 12 to ball return apparatus 18 which ejects cleaned balls 23 with a stream of air from blower 112 to propel balls 23 through chute 110. Balls 23 are then mechanically conveyed back to confined play area 14 by rail assembly 122. Power for the motor 48, pump 68 and blower 112 is supplied from power source 50 which operates through a suitable control 52, as is shown in FIG. 1.

It may therefore be appreciated that ball play system 10 incorporating ball cleaning apparatus 12 provides a method for cleaning balls 12 which are used in confined play area 14. This method for cleaning balls includes the first step of depositing balls 22 contained in confined play area 14 into at least one ball supply outlet 28 located in confined play area 14. The next step includes a mechanically conveying balls 22 to a storage bin 44. The next step then includes mechanically conveying balls 22 from a storage bin 44 to ball cleaning apparatus 12. The next step includes cleaning balls 22 in cleaning fluid 42 contained in ball cleaning apparatus 12. The next step includes returning the cleaned ones of balls 22 to confined play area 14. Returning the cleaned ones of balls 22 to confined play area 14 is achieved by providing at least the pair of continuous rails 52 so that the cleaned ones of balls 22 can roll therealong by gravity. Such other processing steps as described above with respect to the ball play system can be incorporated in this method.

The ball play system incorporating the ball cleaning apparatus of the present invention efficiently and effectively cleans balls used in a child's confined play area while children are frolicking thereabout. To save labor and attendant costs, the children frolicking about the confined play area supply the balls to the ball cleaning apparatus. Also, the balls can be continuously cleaned while the children are frolicking in the play area. Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. A ball play system, comprising:

(a) a confined play area of sufficient size so that children may play therein, said confined play area having a ball supply outlet and a ball inlet;

(b) a plurality of balls disposed in said confined play area:

(c) a target structure disposed in said confined play area, with said ball supply outlet being associated with said target structure and constructed such that first balls that are accurately directed toward a target area of said target structure will be received by said ball supply outlet while second balls that are inaccurately directed toward the target area of said target structure will rebound into said confined play area;

(d) a ball cleaning apparatus operative to clean the balls in a cleaning fluid to define cleaned balls;

(e) a conveyor in communication with the ball supply outlet and operative to convey the balls from the ball supply outlet to said ball cleaning apparatus; and (f) a ball return apparatus in communication with said ball cleaning apparatus and operative to receive said cleaned balls from said ball cleaning apparatus and to return said cleaned balls into said confined play area at the ball inlet.

2. A ball play system according to claim 1 wherein the target area is a bullseye.

3. A ball play system according to claim 1 wherein the target structure is a basketball hoop assembly and the target area is a basketball hoop.

4. A ball play system according to claim 1 wherein said ball cleaning apparatus includes a storage bin operative to receive balls from said first conveyor, said storage bin having a storage bin outlet sized such that said balls exit therefrom in single file.

5. A ball play system according to claim 4 including a stirring element disposed in said storage bin, said stirring element operative to circulate balls in said storage bin.

6. A ball play system according to claim 4 wherein said ball cleaning apparatus includes an upright tube section communicating with said storage bin outlet and operative to receive balls therefrom in single file, and including at least one spray nozzle disposed in said upright tube and oriented to direct a spray of the cleaning fluid onto said balls as said balls pass therethrough to produce said cleaned balls.

7. A ball play system according to claim 6 wherein said cleaning apparatus includes a transverse tube section in communication with said upright tube section and operative to receive said cleaned balls therefrom and to convey said cleaned balls to said ball return apparatus.

8. A ball play system according to claim 7 wherein said cleaning apparatus includes a reservoir of the cleaning fluid, a pump operative too circulate the cleaning, fluid from said reservoir to said spray nozzle and having a drain operative to drain cleaning fluid from said cleaned balls back into said reservoir.

9. A ball play system according to claim 1 wherein said ball return apparatus includes an upright chute disposed to receive said cleaned balls and a blower operative to direct a stream of air against each of said cleaned balls that enters said chute thereby to propel each said cleaned ball upwardly through said chute to a chute outlet.

10. A ball play system according to claim 9 wherein said ball return apparatus includes at least a rail assembly in communication with said chute at the chute outlet and operative to receive said cleaned balls from said chute and convey said cleaned balls to the ball inlet of said confined play area.

11. A ball play system according to claim 10 wherein said rail assembly is serpentine in configuration and is structured so that said cleaned balls are advanced therealong by gravity.

12. A method for cleaning balls used in a confined play area sized and adapted for children to play therein, comprising the steps of:

(a) depositing the balls contained in the confined play area into a ball supply outlet located in the confined play area;

(b) mechanically conveying the balls to a cleaning apparatus located remotely of the confined play area;

(c) cleaning the balls with a cleaning fluid associated with said ball cleaning apparatus to define cleaned balls; and (d) returning cleaned ones of the balls to the confined play area by pneumatically propelling said cleaned balls from the ball cleaning apparatus to a rail assembly that receives the cleaned balls and that is configured so that said balls travel to the confined play area under the force of gravity with said rail assembly having a serpentine path of sufficient length such that said cleaned balls at least partially dry during transit.

13. A method for cleaning balls according to claim 12 including a step of mechanically conveying the balls to a storage bin associated with said cleaning apparatus after step (a).

14. A method for cleaning balls according to claim 13 including a step mechanically conveying the balls from said storage bin through a spray of cleaning fluid.

15. A ball play system, comprising:

(a) a confined play area of sufficient size so that children may play therein, said confined play area having a ball supply outlet and a ball inlet;

(b) a plurality of balls disposed in said confined play area:

(c) a ball cleaning apparatus operative to clean the balls in a cleaning fluid to define cleaned balls;

(d) a conveyor in communication with the ball supply outlet and operative to convey the balls from the ball supply outlet to said ball cleaning apparatus; and (e) a ball return apparatus in communication with said ball cleaning apparatus and operative to receive said cleaned balls from said ball cleaning apparatus and to return said cleaned balls into said confined play area at the ball inlet, said ball return apparatus including an upright chute disposed to receive said cleaned balls, a blower operative to direct a stream of air against each of said cleaned balls that enters said chute thereby to propel each said cleaned ball upwardly through said chute to a chute outlet and a rail assembly in communication with said chute at the chute outlet, said rail assembly operative to receive said cleaned balls from said chute and convey said cleaned balls to the ball inlet of said confined play area.

16. A ball play system according to claim 15 wherein said rail assembly is serpentine in configuration and is structured so that said cleaned balls are advanced therealong by gravity.

* * * * *